US006883508B2

(12) United States Patent
Geoffroy

(10) Patent No.: US 6,883,508 B2
(45) Date of Patent: Apr. 26, 2005

(54) METHOD FOR CONTROLLING THE PRIMARY IGNITION CURRENT OF AN INTERNAL COMBUSTION ENGINE WITH CONTROLLED IGNITION

(75) Inventor: Yves Geoffroy, Toulouse (FR)

(73) Assignee: Siemens VDO Automotive, Toulouse Cedex (FR)

( * ) Notice: Subject to any disclaimer, the term of this patent is extended or adjusted under 35 U.S.C. 154(b) by 0 days.

(21) Appl. No.: 10/808,290

(22) Filed: Mar. 25, 2004

(65) Prior Publication Data

US 2004/0206344 A1 Oct. 21, 2004

(30) Foreign Application Priority Data

Apr. 17, 2003 (FR) ..... 03 04834

(51) Int. Cl.[7] ..... F02P 3/12
(52) U.S. Cl. ..... 123/644; 123/609; 73/117.2
(58) Field of Search ..... 123/644, 645, 123/609; 73/117.2, 117.3

(56) References Cited

U.S. PATENT DOCUMENTS 4,030,468 A * 6/1977 Sugiura et al. ..... 123/644
4,290,406 A * 9/1981 Iyoda et al. ..... 123/645
5,735,254 A * 4/1998 Palara et al. ..... 123/644
6,204,693 B1 * 3/2001 Forster et al. ..... 326/89
6,729,317 B2 * 5/2004 Kraus ..... 123/606

FOREIGN PATENT DOCUMENTS

| | | |
|---|---|---|
| EP | 0 559 540 | 9/1993 |
| EP | 0 590 181 | 4/1994 |
| FR | 2 820 465 | 8/2002 |

* cited by examiner

*Primary Examiner*—Carl S. Miller
(74) *Attorney, Agent, or Firm*—Young & Thompson

(57) ABSTRACT

Method for controlling a primary current in an ignition coil of an internal combustion engine with controlled ignition, the current is established in an inductive primary circuit over a given conduction time. The conduction time is calculated by:

predetermining the predetermined conduction time, carrying out at least one measurement of the current in the primary circuit at an instant lying in the last tenth of the predetermined conduction time;

estimating the current at the end of the predetermined conduction time, as a function of the measurement(s) carried out;

optionally correcting the conduction time for the ignition cycle during which the last current measurement was carried out, as a function of the previous estimate and the current desired at the end of the conduction time.

8 Claims, 1 Drawing Sheet

METHOD FOR CONTROLLING THE PRIMARY IGNITION CURRENT OF AN INTERNAL COMBUSTION ENGINE WITH CONTROLLED IGNITION

BACKGROUND OF THE INVENTION

The present invention relates to a method for controlling the primary ignition current in an internal combustion engine with controlled ignition.

In such an engine, a fuel/oxidant mixture is ignited with the aid of a spark in order to cause a driving explosion. The spark is produced by a spark plug. The latter has two electrodes, between which an electric arc is induced in order to form the spark. A fairly large potential difference is required between the electrodes in order to be able to create an arc, but it is also necessary for a current to flow between the electrodes in order to supply enough energy to the fuel/oxidant mixture and ignite it.

DESCRIPTION OF THE RELATED ART

Conventionally, the large potential difference across the terminals of the electrodes of the spark plug is obtained by breaking the current in a circuit that has a primary winding, and by amplifying the overvoltage which results therefrom in a secondary winding. A current is passed through the primary circuit for a determined time known as the dwell time, also referred to as the conduction time. A conventional duration is of the order of 3 to 4 milliseconds. The current in the primary circuit increases progressively throughout the dwell time. It is important to perfectly control the value of the current at the time when the circuit is broken. This is because the energy delivered to the spark plug will not be sufficient to ignite the fuel/oxidant mixture if this current is too weak. However, thermal problems occur in the coil if this current is too large: it will become heated by the Joule effect if the current flowing through it is too large, which creates parasitic phenomena. The coils furthermore are tending to become smaller and smaller nowadays, and are using wires with a smaller and smaller diameter. For this reason, they are more sensitive to thermal problems than coils of larger sizes.

The current increases substantially linearly while the current is established in the primary circuit, but this growth becomes faster at the end of the dwell time. It is therefore expedient to perfectly control this dwell time, because a small variation of it entails a very substantial variation of the current in the primary circuit at the moment when the circuit is broken.

A plurality of methods and devices for optimally controlling this current are known. The method and the device disclosed by document FR-2 820 465 will be cited here as an example. The problem explained above is discussed in the preamble of that document. The solution proposed in that document is to define a time window of predetermined width. An analog-digital converter (ADC) then takes current measurements at regular intervals. If an acquisition is made in the predefined time window, then this measurement will be taken into account. The behavior of the curve giving the current with respect to time is then studied as a function of the values which are obtained. The behavior of this curve in the predefined time window is used as a basis for deducing the behavior of this curve at the moment when the electrical circuit is broken. This method gives good results, but it is fairly difficult to implement because, for each type of coil, it is necessary to determine a set of coefficients making it possible to calculate the behavior of the current at the time when the primary circuit is broken, on the basis of the acquisitions made in the predefined window.

SUMMARY OF THE INVENTION

It is therefore an object of the present invention to provide a method for controlling the current in the primary circuit which is at least equally reliable but without requiring calibration to be carried out as is the case for the method described in the aforementioned document. Preferably, implementation of the method according to the invention does not require extra expenditure on the ignition circuit.

To this end, it provides a method for controlling a primary current in an ignition coil of an internal combustion engine with controlled ignition, in which the current is established in an inductive primary circuit over a given duration, referred to as the conduction time and determined by calculation and/or as a function of measurements carried out in the primary circuit.

According to the present invention, the conduction time is calculated according to the following steps:

predetermining the conduction time, carrying out at least one measurement of the current in the primary circuit at an instant lying in the last tenth of the predetermined conduction time, estimating the current at the end of the predetermined conduction time, as a function of the measurement(s) carried out, optimally correcting the conduction time for the ignition cycle during which the last current measurement was carried out, as a function of the previous estimate and the current desired at the end of the conduction time.

Carrying out a measurement in the last tenth of the conduction time makes it possible to obtain a good approximation of the current when the circuit is opened. This makes it possible to gain precision in the determination of the conduction time. It is thus superfluous to precisely characterize the ignition coils in order to extrapolate their behavior just before the primary circuit is opened, because the measurement which is taken gives a fairly precise indication of this behavior.

The correction of the conduction time may be performed for the ignition cycle during which the last current measurement was carried out, although it may also be performed during a subsequent cycle.

In one embodiment of the invention, the predetermined conduction time is obtained for example, on the basis of tables stored in a management and control device of the ignition coil, as a function in particular of parameters such as the potential difference applied to the terminals of the primary circuit.

In a preferred embodiment, the estimation of the current at the end of the predetermined conduction time is carried out on the basis of a measurement by linear extrapolation. Such an extrapolation is easy to carry out, and gives very good results in the present case. A higher-order extrapolation may nevertheless be employed so as to increase the precision of the method, although the gain in precision is not very substantial in this case.

In order to avoid a "granularity" effect of the measurement and not to obtain significant correction differences from one ignition cycle to the next cycle, with respect to the value of the predetermined conduction time, the control method according to the invention proposes that the estimation of the current at the end of the predetermined conduction time be carried out by linear extrapolation of the measurement carried out, by forming an average with measurements taken previously. In this case, for example, a moving average of the estimated final current is formed.

As for the estimation of the final current, the correction of the conduction time is preferably carried out linearly as a function of the final current, whether or not it is averaged.

The control method according to the invention makes it possible for the desired final current to be determined as a function of the speed of the engine in question. In this case, when it is calculated on the basis of tables, the predetermined conduction time also depends on the speed of the engine in question.

BRIEF DESCRIPTION OF THE DRAWINGS

Details and advantages of the present invention will become more readily apparent from the following description, which is given with reference to the appended schematic drawing, in which.

DESCRIPTION OF THE PREFERRED EMBODIMENTS

Figure 1:
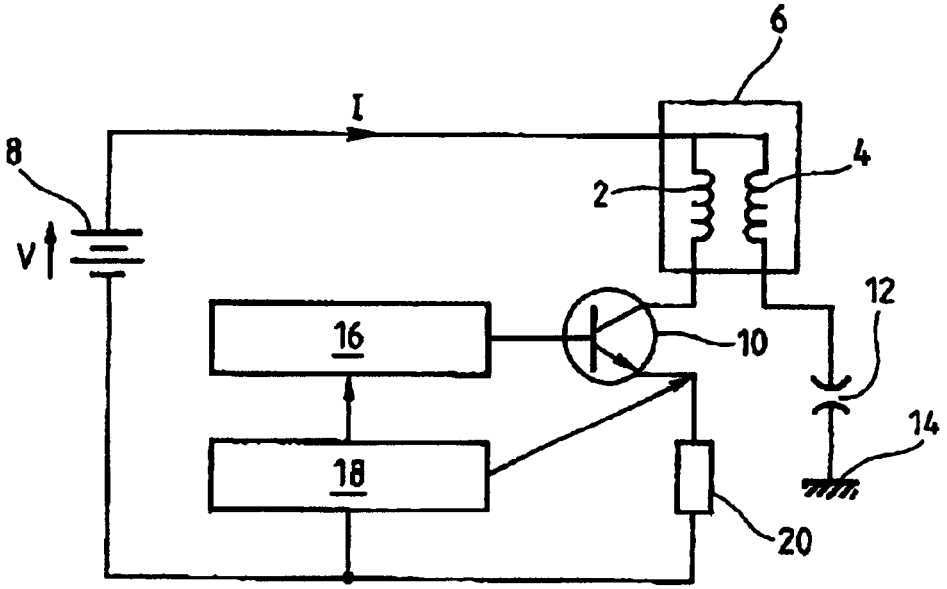
FIG. 1 schematically represents an ignition system for an internal combustion engine with controlled ignition.

FIG. 1 schematically represents an ignition device for an internal combustion engine with controlled ignition. This figure shows a conventional ignition coil. This coil has a primary winding 2 also commonly referred to as the "primary", and a secondary winding 4 commonly referred to as the "secondary". These two windings interact with one another so as to form a step-up voltage transformer 6.

The primary winding 2 is supplied by a voltage source 8, which is usually the battery of the vehicle in question. A switch 10, which here is in the form of a transistor, controls the electrical supply of the primary winding 2.

The secondary winding 4 has one terminal in common with the primary winding 2. The other terminal of the secondary winding 4 is connected to an electrode of a spark plug 12, the other electrode of this spark plug being connected to the ground 14.

A spark is produced when a large potential difference is formed between the electrodes of the spark plug 12, and if the energy in the spark is sufficient, it makes it possible to ignite a fuel/oxidant mixture surrounding the electrodes of the spark plug 12. This large potential difference is produced by causing an overvoltage across the terminals of the primary winding 2. As is known, an overvoltage is produced across the terminals of a winding having an inductance when the electrical circuit containing this inductance is opened. This overvoltage across the terminals of the primary winding is amplified by the transformer 6, and a voltage of several kV is thus conventionally obtained at the secondary winding 4, and therefore across the electrodes of the spark plug 12. A management and control device 16 of the igntion coil controls the opening and closing of the transistorized switch 10.

This management and control device 16 is connected to a central processing unit which manages the engine, and from which it can receive information such as the speed N of the engine in question, for example. This control and management device 16 also receives information about the primary circuit of the ignition coil. It thus knows the potential difference V provided by the voltage source 8 and the current I flowing through this primary circuit. An analog/digital converter 18 (or ADC) makes it possible to measure the current I. This converter 18 actually measures a potential difference across the terminals of a known resistor 20. A microcontroller integrated in the converter 18 manages the acquisitions made by it. When a measurement is taken, the instant at which this measurement is taken is thus known precisely. This measurement can thus be localized with respect to the closing of the switch 10, i.e. with respect to the start of the establishment of a current in the primary circuit.

Figure 2:
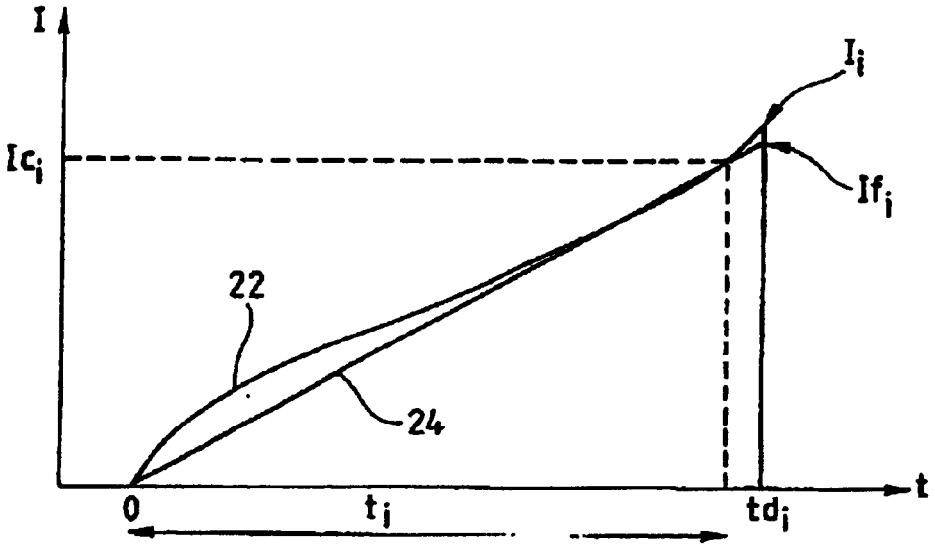
FIG. 2 is a curve representing the variations of the current in the primary circuit during the dwell time.

FIG. 2 presents a curve 22 showing the variation of the current I in the primary circuit as a function of time t. The switch 10 is assumed to close at the instant t=0 and open at the instant $t=td_I$.

The current is zero at the instant t=0, whereas the current in the primary circuit is equal to $I_I$ at the instant $t=td_I$.

It will be noted that the current I increases more rapidly close to $td_I$ (i.e. there is an increasing dI/dt). This curve 22 corresponds to a current curve that is generally observed in the primary circuit of an ignition coil.

In order for the spark to be produced in the spark plug 12 after the primary circuit is opened at the instant $t=td_i$, it is necessary that $I_i>=I_{ref}$, where $I_{ref}$ corresponds to the minimum value making it possible to ignite the fuel/oxidant mixture.

As mentioned in the preamble, it is expedient for the value $I_i$ not to exceed the value $I_{ref}$ too much, so as to avoid the risk of damaging the coil. As is known to the person skilled in the art, the value of $I_i$ can be controlled directly by adjusting the value $td_i$, which corresponds to the dwell time for the i-th ignition cycle. The value of the current $I_i$ flowing through the primary circuit at the end of the conduction time is increased by increasing this dwell time, or conduction time, of the i-th cycle. Conversely, the current at the end of the ignition cycle is decreased by decreasing the dwell time.

In order to optimally adjust the value of the current at the end of the dwell time, and to obtain a current as close as possible to a value $I_{target}$ in the primary circuit at the moment when the switch 10 is opened, the present invention proposes that a measurement of the current be taken with the aid of the converter 18 at an instant $t_i$ very close to $td_i$. Preferably, $t_i>=0.9\ td_i$ is selected.

The value $td_i$ is, for example, calculated by the control and management device 16 with the aid of a table which is stored in it, and which gives a dwell time for each cycle as a function of the voltage V across the terminals of the voltage source 8.

The value of the current measured at the instant $t=t_I$ is $Ic_I$.

The straight line 24 passing through the origin and through the point ($t_I$, $Ic_i$) is then determined. The equation of this straight line is as follows:

$$I=(Ic_I/t_I)\cdot t$$

In order to make an estimate of the current at the end of the conduction time in this case, the intersection of the straight line 24 with the straight line of equation $t=td_i$ is calculated. The point with coordinates ($td_I$, $If_I$) is then found, where $If_I$ is the estimated value of the current at the end of the conduction time. The value of $If_I$ is then compared with the value $I_{target\ i}$ of the current which one desires to obtain when the switch 10 is opened. In the event that $If_i=I_{target\ I}$, then the control and management device 16 will of course open the switch 10 at the instant $t=td_I$. Otherwise, a new dwell time is calculated. It is calculated by linear approximation, for example, which then gives the following equation:

$$td_{cor\ i}=(I_{target\ i}/If_i)\cdot td_i$$

A correction coefficient is therefore applied to the value of the dwell time, or conduction time, previously determined by the control and management device 16, in particular as a function of the voltage V across the terminals of the voltage source 8.

This method works in theory and in practice, and it makes it possible to obtain a satisfactory current when the primary circuit is opened. It will be noted that in view of the shape of the curve 22, in particular close to its end (on the right in FIG. 2), the actual current is normally slightly greater than the target current. This difference is very small and does not risk damaging the ignition coil.

In view of the measurement uncertainties, as regards both the current and the time, it is preferable to average the measurements which are carried out. This avoids "granularity" effects of the measurement, which effects are well known to the person skilled in the art. The invention then proposes that $td_{cor\ i}$ be calculated not only as a function of the measurement taken during the i-th cycle, but also as a function of the measurements taken during the (n−1) previous cycles. The final current is then estimated as a function of the final current estimated during the previous cycle and of the value of the final current estimated in the present cycle. This gives the following equation:

$$If_{av\ i}=((n-1)If_{av\ i-1}+If_i)/n$$

where $If_{av\ i}$ is the value of the current estimated at the end of the i-th cycle, and $If_{av\ i-1}$ is the value of the current estimated at the cycle end during the previous cycle.

The formula indicated above may again be adopted in order to calculate $td_{cor\ i}$ in this case, but as a variant, it is also possible to proceed in the following way. Firstly, a correction coefficient $k_I$ is calculated as a function of the same correction coefficient $k_{I-1}$ calculated during the previous cycle. $k_I$ is then defined in the following way:

$$k_I=k_{I-1}+[\text{filter}\cdot(I_{target\ i}-If_{av\ i})/I_{target\ i}]$$

where filter is a fixed coefficient stored in the control and management device 16.

The corrected conduction time is then calculated in the following way:

$$td_{cor\ i}=k_i\cdot td_i$$

Therefore, the method as described above simply and reliably makes it possible to obtain a current at the moment when the primary circuit is opened, the characteristics of which make it possible to have sufficient energy in the corresponding spark plug 12 without creating any heat-related problem in the ignition coil.

In order to obtain even better precision, the invention proposes that the current $I_{target}$ be varied as a function of the engine speed. Of course, varying the value of $I_{target}$ also varies the value of the dwell time predetermined by the control and management device. This value, which is predetermined by the control and management device 16, then depends both on the voltage V across the terminals of the voltage source 8 and the speed of the engine N.

Compared with the known methods of the prior art, the method according to the invention has the advantage of being very simple while also being very accurate. The only calibrations to be carried out when implementing this method involve establishing the tables which give the value of the current $I_{target}$ as a function of the voltage existing across the terminals of the voltage source that supplies the primary circuit, and optionally also of the engine speed. It is therefore sufficient to produce a dwell table such as that which is conventionally produced for any electronic ignition system.

Furthermore, there are no significant variations from one correction to another in the embodiment which averages the measurements carried out previously. The correction made with respect to the dwell table stored in the control and management device is thus progressive.

The present invention is not limited to the embodiments which have been described above by way of nonlimiting examples. It also relates to all the alternative embodiments within the capacity of the person skilled in the art, in the scope of the appended claims.

For example, two measurements of the current could be carried out during the dwell time, one of which is close to the end of this dwell time, in order to try to improve the precision of the method. It is also conceivable to provide a higher-order approximation here, instead of an estimate by linear approximation.

The above description uses an arithmetic mean in order to average the measurements which are taken. Other averages may also be formed, without thereby departing from the scope of the present invention.

In the embodiments described above, the measurement(s) is (are) used to modify the conduction time of the ignition cycle during which the measurement is carried out. It is, however, also conceivable to use the corrected measured value in order to determine the conduction time of the next cycle. A converter measuring the current as close as possible to the end of the dwell time, for example, may then be envisaged. The measurement then taken is compared with the current $I_{target}$, and the dwell time of the next cycle is calculated as a function of the measurement which has been carried out. It may be assumed that the measurement which has been carried out gives the actual value of the current at the end of the conduction time, or the value at the end of the conduction time may be estimated by a predetermined formula on the basis of the measurement which has been carried out.

What is claimed is:

1. A method for controlling a primary current in an ignition coil of an internal combustion engine with controlled ignition, in which the current is established in an inductive primary circuit over a given duration, referred to as the conduction time and determined by calculation and/or as a function of measurements carried out in the primary circuit, characterized in that the conduction time is calculated according to the following steps:

predetermining the predetermined conduction time ($td_i$), carrying out at least one measurement of the current ($Ic_i$) in the primary circuit at an instant ($t_i$) lying in the last tenth of the predetermined conduction time ($td_i$) but before the end of the predetermined conduction time, estimating the current ($If_i$) only at the end of the predetermined conduction time ($td_i$), as a function of the measurement or measurements carried out during said last tenth, optimally correcting the conduction time ($td_i$) for the ignition cycle during which the last current measurement was carried out, as a function of the previous estimate and the current ($I_{target\ i}$) desired at the end of the conduction time.

2. The control method as claimed in claim 1, characterized in that the predetermined conduction time ($td_i$) is obtained on the basis of tables stored in a management and control device (16) of the ignition coil, as a function of parameters.

3. The control method as claimed in claim 1, characterized in that the estimation of the current ($If_i$) at the end of the predetermined conduction time ($td_i$) is carried out on the basis of a measurement by linear extrapolation.

4. The control method as claimed in claim 1, characterized in that the estimation of the current ($If_i$) at the end of the predetermined conduction time ($td_i$) is carried out by linear extrapolation of the measurement carried out, by forming an average with measurements taken previously.

5. The control method as claimed in claim 4, characterized in that a moving average of the estimated final current is formed.

6. The control method as claimed in claim 1, characterized in that the correction of the conduction time is carried out linearly as a function of the final current, whether or not it is averaged.

7. The control method as claimed in claim 1, characterized in that the desired final current ($I_{target\ i}$) is determined as a function of the speed (N) of the engine in question.

8. The control method as claimed in claim 1, characterized in that the predetermined conduction time ($td_i$) is obtained on the basis of tables stored in a management and control device (16) of the ignition coil, as a function of the potential difference (V) applied to the terminals of the primary circuit.

* * * * *